US008523961B2

(12) United States Patent
Sugita et al.

(10) Patent No.: US 8,523,961 B2
(45) Date of Patent: Sep. 3, 2013

(54) METHOD FOR MANUFACTURING BRIQUETTED SOLID FUEL USING POROUS COAL AS STARTING MATERIAL

(75) Inventors: Satoru Sugita, Takasago (JP); Yuko Sugita, legal representative, Kobe (JP); Yutaka Mitou, Takasago (JP); Seiichi Yamamoto, Takasago (JP); Takuo Shigehisa, Takasago (JP); Shigeru Kinoshita, Takasago (JP); Takahiro Shimizu, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 271 days.

(21) Appl. No.: 13/124,133

(22) PCT Filed: Oct. 9, 2009

(86) PCT No.: PCT/JP2009/067622

§ 371 (c)(1),
(2), (4) Date: Apr. 14, 2011

(87) PCT Pub. No.: WO2010/044376

PCT Pub. Date: Apr. 22, 2010

(65) Prior Publication Data

US 2012/0291342 A1 Nov. 22, 2012

(30) Foreign Application Priority Data

Oct. 14, 2008 (JP) ..... 2008-265504

(51) Int. Cl.

| | |
|---|---|
| ***C10L 1/32*** | (2006.01) |
| ***C10L 5/00*** | (2006.01) |
| ***C10B 1/00*** | (2006.01) |

(52) U.S. Cl.
USPC ..... 44/592; 44/282; 44/608

(58) Field of Classification Search
USPC ..... 44/550, 564, 569, 594, 595, 596, 44/597, 598, 592, 608, 282
See application file for complete search history.

(56) References Cited

U.S. PATENT DOCUMENTS 5,554,201 A 9/1996 Yagaki et al.
5,556,436 A 9/1996 Yagaki et al.

(Continued)

FOREIGN PATENT DOCUMENTS

GB 2033924 A * 5/1980
JP 68731 6/1926

(Continued)

OTHER PUBLICATIONS

U.S. Appl. No. 13/290,466, filed Nov. 7, 2011, Sugita, et al.

(Continued)

*Primary Examiner* — Pamela H Weiss
(74) *Attorney, Agent, or Firm* — Oblon, Spivak, McClelland, Maier & Neustadt, L.L.P.

(57) ABSTRACT

Provided is a manufacturing method for a briquetted solid fuel that can reduce the briquetting cost while maintaining the strength of the briquetted product. A mixed oil that includes a heavy oil and a solvent oil, and a porous coal are mixed to obtain a slurry. The slurry is dewatered by heating to obtain a dewatered slurry. Solvent oil is separated from the dewatered slurry to obtain a cake, the cake is heated, and solvent oil is further separated from the cake to obtain a modified coal. Moisture is added to the modified coal to obtain a moist modified coal with a moisture content of 3 wt % to 10 wt %, and then the moist modified coal is briquetted under pressure.

7 Claims, 2 Drawing Sheets

(56) References Cited

U.S. PATENT DOCUMENTS

| | | | | |
|---|---|---|---|---|
| 2003/0046864 | A1 | 3/2003 | Shimasaki et al. | |
| 2005/0097814 | A1 * | 5/2005 | Sugita et al. | 44/620 |
| 2007/0062103 | A1 | 3/2007 | Sugita et al. | |
| 2010/0077658 | A1 | 4/2010 | Sugita et al. | |
| 2011/0005126 | A1 | 1/2011 | Sugita et al. | |

FOREIGN PATENT DOCUMENTS

| | | |
|---|---|---|
| JP | 54 81301 | 6/1979 |
| JP | 58 83087 | 5/1983 |
| JP | 7 233383 | 9/1995 |
| JP | 2003 64377 | 3/2003 |
| JP | 2005 139342 | 6/2005 |

OTHER PUBLICATIONS

Office Action issued Dec. 21, 2012 in German Patent Application No. 11 2009 002 456.4 (with English translation).
U.S. Appl. No. 13/120,369, filed Mar. 22, 2011, Yamamoto, et al.
U.S. Appl. No. 12/995,010, filed Nov. 29, 2010, Yamamoto, et al.
International Search Report issued Dec. 15, 2009 in PCT/JP09/067622 filed Oct. 9, 2009.

* cited by examiner

METHOD FOR MANUFACTURING BRIQUETTED SOLID FUEL USING POROUS COAL AS STARTING MATERIAL

This application is a 371 of PCT/JP09/67622, filed Oct. 9, 2009. Priority to Japanese patent application 2008-265504, filed Oct. 14, 2008, is claimed.

TECHNICAL FIELD

The present invention relates to a method for manufacturing a briquetted solid fuel using a porous coal, such as brown coal, as a starting material.

BACKGROUND ART

With respect to a method for manufacturing a solid fuel using a porous coal, such as brown coal, as a starting material, the manufacturing method described in Patent Document 1 has been conventionally known. The method for manufacturing a solid fuel described in Patent Document 1 is characterized by mixing a mixed oil including a heavy oil component and a solvent oil component with a porous coal to obtain a starting material slurry, heating the slurry to dewater the porous coal and to impregnate the pores of the porous coal with the mixed oil including the heavy oil component and the solvent oil component, and then solid-liquid separating and drying the slurry.

In the method for manufacturing a solid fuel described in Patent Document 1, moisture in the pores of the porous coal is evaporated by heating the starting material slurry (i.e., mixture of the mixed oil including a heavy oil component and a solvent oil component with the porous coal). At the same time, the inside of the pores is covered with the mixed oil including the heavy oil component. Finally, the pores are filled with the mixed oil, in particular, the heavy oil component preferentially. Consequently, adsorption of oxygen to active sites in the pores and oxidation are suppressed, and thus spontaneous combustion of the porous coal is suppressed. Furthermore, the heavy oil component is filled in the pores by the heating, resulting in an increase in the calorific value of the porous coal. Hence, according to the method for manufacturing a solid fuel described in Patent Document 1, it is possible to obtain a solid fuel having a low moisture content, low spontaneous combustibility, and an increased calorific value.

However, in the method for manufacturing a solid fuel described in Patent Document 1, since the modified coal (solid fuel) after being subjected to the drying step is in powder form, a problem occurs with respect to its transportation. Specifically, use of the modified coal in powder form may result in an increase in transportation costs and may cause dust pollution because of the low bulk density, leakage during transportation, and fly loss. Consequently, it is desirable to briquette the modified coal in powder form using a briquetting machine. In this process, the modified coal in powder form cannot be briquetted unless under high pressure. Therefore, it has been a problem to reduce the briquetting cost. Note that, if the strength of briquettes is not high enough, the briquettes will be easily pulverized during handling.

As the technique for briquetting a modified coal in powder form, for example, the method for manufacturing a briquette coal described in Patent Document 2 has been conventionally known. In the manufacturing method described in Patent Document 2, starch is added to a coal in powder form, mixing is performed, and the resulting mixture is briquetted under pressure. That is, in this method, starch is used as a binder.

Patent Document 1: Japanese Unexamined Patent Application Publication No. 7-233383

Patent Document 2: Japanese Unexamined Patent Application Publication No. 2003-64377

DISCLOSURE OF INVENTION

Problems to be Solved by the Invention

However, in the briquetting method described in Patent Document 2 in which starch is used as a binder, it is necessary to add starch at least in an amount of several percent to a coal in powder form, and such addition of starch in an amount of several percent is not realistic in terms of the briquetting cost.

The present invention has been achieved under the circumstances described above, and it is an object of the present invention to provide a method for manufacturing a briquetted solid fuel that can reduce the briquetting cost while maintaining the strength of the briquetted product.

Means for Solving the Problems

As a result of diligent research in order to solve the problems described above, the present inventors have found that by adjusting the moisture content of a modified coal after being subjected to a drying step to 3 wt % to 10 wt %, and briquetting the modified coal under pressure, it is possible to manufacture a briquetted product (briquetted solid fuel) having high strength without using a binder, such as starch, which can solve the problems described above. The present invention has been completed on the basis of the finding.

That is, according to the present invention, a method for manufacturing a briquetted solid fuel includes a mixing step of mixing a mixed oil including a heavy oil and a solvent oil with a porous coal to obtain a slurry, an evaporation step of dewatering the slurry by heating to obtain a dewatered slurry, a solid-liquid separation step of separating the solvent oil from the dewatered slurry to obtain a cake, a drying step of heating the cake to further separate the solvent oil from the cake to obtain a modified coal, a moisture addition step of adding moisture to the modified coal to obtain a moist modified coal with a moisture content of 3 wt % to 10 wt %, and a briquetting step of briquetting the moist modified coal under pressure. Here, the moisture content refers to the percentage (mass basis) of water contained in a mixture of a modified coal and a pulverized porous coal, and obtained by dividing the mass of water contained in the mixture of the modified coal and the pulverized porous coal by the mass of the mixture. In the case where the pulverized porous coal is not contained, the moisture content refers to the percentage (mass basis) of water contained in the modified coal, and obtained by dividing the mass of water contained in the modified coal by the mass of the modified coal. Furthermore, the modified coal refers to a coal which has been modified by reducing the percentage of moisture so as to increase the calorific value per unit mass.

Furthermore, in the present invention, in the moisture addition step, preferably, a pulverized coal obtained by pulverizing the porous coal is mixed with the modified coal. Thereby, the cost of the product can be reduced. The reason for this is that the moisture of the pulverized coal which is not required to be subjected to modification treatment can be used as moisture adding means in the moisture addition step. Consequently, the moisture addition step can be carried out simply by mixing the modified coal after being subjected to modification treatment and the pulverized coal which has not been subjected to modification treatment, using a known device, such as a mixer.

Furthermore, in the present invention, in the moisture addition step, preferably, waste water obtained in the evaporation step is supplied to the modified coal. For example, the waste water can be supplied by spraying to the modified coal. Thereby, it is possible to obtain an effect of decreasing the amount of water to be treated in the waste water treatment facilities of the plant.

Advantages

According to the present invention, because of its constitutional features, in particular, by adding moisture to the modified coal which has been subjected to the drying step to obtain a moist modified coal with a moisture content of 3 wt % to 10 wt %, and briquetting the moist modified coal under pressure, bonds between particles can be strengthened. As a result, it is possible to manufacture a briquetted solid fuel having high strength without using a binder, such as starch. That is, it is possible to reduce the briquetting cost while maintaining the strength of the briquetted product.

Figure 1:
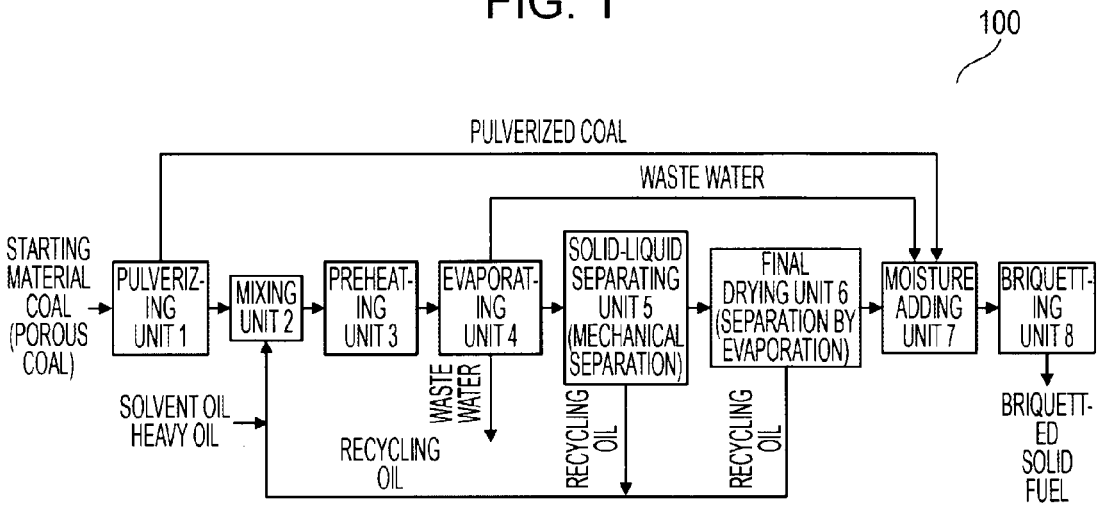
FIG. 1 is a flow chart showing a method for manufacturing a briquetted solid fuel according to an embodiment of the present invention and also a block diagram of a manufacturing apparatus for a briquetted solid fuel.

| Reference Numerals | |
|---|---|
| 1 | pulverizing unit |
| 2 | mixing unit |
| 3 | preheating unit |
| 4 | evaporating unit |
| 5 | solid-liquid separating unit |
| 6 | final drying unit |
| 7 | moisture adding unit |
| 8 | briquetting unit |
| 100 | manufacturing apparatus for briquetted solid fuel |

BEST MODES FOR CARRYING OUT THE INVENTION

Best modes for carrying out the present invention will be described below with reference to the drawings.

FIG. 1 is a flow chart showing a method for manufacturing a briquetted solid fuel according to an embodiment of the present invention and also a block diagram of a manufacturing apparatus 100 for a briquetted solid fuel. As shown in FIG. 1, the manufacturing apparatus 100 includes a pulverizing unit 1 for pulverizing a porous coal (starting material coal), a mixing unit 2 for mixing the porous coal pulverized in the pulverizing unit 1 with a mixed oil including a heavy oil and a solvent oil, a preheating unit 3 for preheating a slurry obtained in the mixing unit 2, an evaporating unit 4 for dewatering the slurry, a solid-liquid separating unit 5 for mechanically separating the solvent oil from the dewatered slurry obtained in the evaporating unit 4, a final drying unit 6 for heating a cake separated in the solid-liquid separating unit 5 to further separate the solvent oil from the cake, a moisture adding unit 7 for adding moisture to the modified coal in powder form obtained in the final drying unit 6, and a briquetting unit 8 for briquetting under pressure the moist modified coal obtained in the moisture adding unit 7.

The individual steps in the method for manufacturing a briquetted solid fuel according to the embodiment will be described in detail below.

(Pulverization Step)

First, a porous coal (starting material coal) is fed to the pulverizing unit 1 and pulverized. Here, the porous coal (starting material coal) to be fed to the pulverizing unit 1 is, for example, a so-called low-rank coal having a moisture content of 30 wt % to 70 wt % and desired to be dewatered. Examples of such a porous coal include brown coal, lignite, and sub-bituminous coal. Examples of the brown coal include Victorian coal, North Dakota coal, and Berga coal. Examples of the sub-bituminous coal include West Banko coal, Binungan coal, Samarangau coal, and Ecocoal coal. Furthermore, the pulverized porous coal has a particle size of, for example, about 0.05 to 3 mm, and an average particle size of about several hundred micrometers. Furthermore, wt % refers to % by mass (mass ratio). In addition, in the case where a porous coal (starting material coal) originally having a small particle size is carried in, it is not particularly necessary to pulverize the porous coal (starting material coal).

(Mixing Step)

Next, a mixed oil including a heavy oil and a solvent oil is mixed with the pulverized porous coal in the mixing unit 2 to obtain a slurry. The term "heavy oil" refers to a heavy fraction, such as a vacuum residual oil, that substantially has no vapor pressure at, for example, 400° C. or oil containing a large amount (specifically, 50 wt % or more) of the heavy fraction. The term "solvent oil" refers to an oil that dissolves and disperses a heavy oil. As the solvent oil, in view of affinity with the heavy oil, the handling property as the slurry, ease of penetration into pores, and the like, for example, a light oil fraction is used. Taking the stability at the moisture evaporation temperature into consideration, it is recommended to use a petroleum-derived oil having a boiling point of 100° C. to 300° C. Examples of the petroleum-derived oil include kerosene, light oil, and fuel oil. By mixing the heavy oil and the solvent oil, a heavy oil-containing mixed oil is produced. By using such a heavy oil-containing mixed oil, the heavy oil-containing mixed oil exhibits adequate fluidity and penetration of oil into the pores of the porous coal is promoted.

The mixing unit 2 is constituted by a mixing tank for receiving and mixing the mixed oil and the porous coal, an agitator provided on the mixing tank, and the like.

(Evaporation Step)

Next, the slurry obtained in the mixing unit 2 is preheated in the preheating unit 3, and then dewatered in the evaporating unit 4 to obtain a dewatered slurry. The slurry is heated, for example, to 70° C. to 100° C. in the preheating unit 3, and then fed to an evaporation tank in the evaporating unit 4, in which the moisture contained in the porous coal in the slurry is evaporated to dewater the slurry. Simultaneously with the dewatering treatment, the pores of the porous coal are impregnated with the mixed oil, and the pores are filled with the heavy oil component preferentially. Furthermore, the moisture contained in the porous coal in the slurry is discharged as waste water from the evaporating unit 4.

The preheating unit 3 is constituted by a heat exchanger and the like. The evaporating unit 4 is constituted by an evaporation tank for receiving the slurry obtained in the mixing unit 2 and evaporating the moisture of the slurry, an agitator provided on the evaporation tank, a heat exchanger for heating the slurry, and the like. As the heat exchanger, a multitubular heat exchanger, a plate-type heat exchanger, a spiral type heat exchanger, or the like is used.

(Solid-Liquid Separation Step)

Next, the solvent oil is mechanically separated from the dewatered slurry to obtain a cake. The dewatered slurry is fed to a solid-liquid separator in the solid-liquid separating unit 5 and subjected to solid-liquid separation. As the solid-liquid separator, for example, from the standpoint of improving the separation efficiency, a centrifugal separator is used in which the dewatered slurry is separated into the cake and the solvent oil by a centrifugal separation method. It may also be possible to use a solid-liquid separator that uses a sedimentation method, a filtration method, an expression method, or the like.

(Drying Step)

The cake separated in the solid-liquid separation step is still wet because of the mixed oil. Therefore, the cake is heated in the final drying unit 6 to further separate the solvent oil. Thereby, the cake is converted into a modified coal in powder form. The final drying unit 6 is constituted by a drying machine, a gas cooler, and the like. As the drying machine, a drying machine capable of heating an object to be treated while continuously transporting the object to be treated inside, and for example, a steam tube type dryer having a plurality of heating steam tubes axially disposed on an inner surface of a drum is used.

The cake is heated in the drying machine, and the oil component, in particular, the solvent oil component in the cake is evaporated. The evaporated solvent oil component is transferred by a carrier gas from the drying machine to the gas cooler. The solvent oil component transferred to the gas cooler is condensed in the gas cooler and recovered.

(Recycling Step)

The solvent oil separated and recovered from the dewatered slurry or the cake in the solid-liquid separating unit 5 and the final drying unit 6 is returned as a recycling oil to the mixing unit 2. The solvent oil returned to the mixing unit 2 is reused for adjustment of the slurry in the mixing unit 2. Furthermore, the recycling oil to be returned to the mixing unit 2 is mostly composed of the solvent oil component, but the recycling oil contains a slight amount of the heavy oil component.

(Moisture Addition Step)

Moisture is added to the modified coal in powder form obtained through the drying step to obtain a moist modified coal with a moisture content of 3 wt %, to 10 wt % in the moisture adding unit 7. In order to add moisture to the modified coal, there are at least two methods. In the first method, moisture is added by mixing the starting material porous coal pulverized in the pulverizing unit 1 with the modified coal in powder form discharged from the final drying unit 6. In this method, the moist modified coal is a mixture of the modified coal obtained through the drying step and the pulverized starting material porous coal. That is, the moist modified coal contains not only the modified coal obtained through the drying step but also the pulverized starting material porous coal. In the second method, moisture is added by spraying waste water from the evaporating unit 4 to the modified coal in powder form discharged from the final drying unit 6. One of these two methods only may be used, or both methods may be used in combination. Alternatively, moisture may be added to the modified coal in powder form by a method other than the methods described above.

The moisture adding unit 7 is constituted by a moisture addition tank for receiving and agitating the modified coal in powder form, an agitator provided on the moisture addition tank, and the like.

(Briquetting Step)

Next, the moist modified coal with a moisture content of 3 wt % to 10 wt % is briquetted under pressure in the briquetting unit 8. The modified coal briquetted into briquettes is used as a briquetted solid fuel. The briquetting unit 8 is constituted by a double roll briquetting machine and the like.

In the method for manufacturing a briquetted solid fuel according to the embodiment, in briquetting into a solid fuel, instead of a binder, inexpensive water, in particular, waste water discharged in the manufacturing method is used, and therefore, the briquetting cost can be reduced. Furthermore, by setting the moisture content to a predetermined amount such as that described above, the strength of the briquetted product can be maintained.

EXAMPLE

Next, experimental results on briquetting of modified coal will be described. In this experiment, modified coals with various moisture contents were produced, and the influence of the moisture content on briquettability was studied. In this experiment, moisture was added by mixing a pulverized starting material porous coal to a modified coal in powder form obtained through a drying step. First, the mixing ratio of pulverized porous coal to modified coal obtained through the drying step, and the moisture content in the mixture of modified coal and pulverized porous coal are shown in Table 1.

TABLE 1

| | Mixing ratio of pulverized porous coal (%) | | | | | |
|---|---|---|---|---|---|---|
| | 0 | 10 | 20 | 30 | 50 | 100 |
| Moisture content in mixture (%) | 0.0 | 3.1 | 6.1 | 9.2 | 15.4 | 30.7 |

The moisture content in the pulverized porous coal, as a starting material, alone was 30.7%. Furthermore, in [Table 1], in the mixture in which the mixing ratio of pulverized porous coal is 100%, the ratio of modified coal obtained through the drying step is zero, and the ratio of pulverized porous coal is 100%. Furthermore, in the mixture in which the mixing ratio of pulverized porous coal is 0%, the ratio of modified coal obtained through the drying step is 100%, and the ratio of pulverized porous coal is zero.

Figure 2:
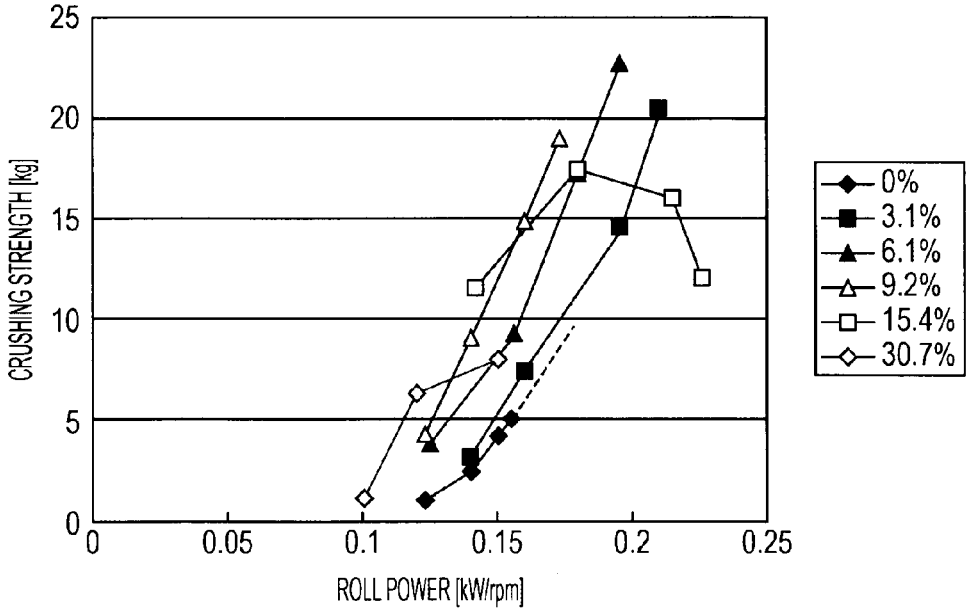
FIG. 2 is a graph showing the influence of mixtures of modified coal and pulverized porous coal on the crushing strength relative to the roll power.

Next, when the six samples shown in [Table 1] are briquetted under pressure using a double roll briquetting machine, the relationship between the crushing strength of briquettes and roll power per unit number of revolutions of the double roll briquetting machine is shown in FIG. 2. FIG. 2 is a graph showing the influence of the moisture content of mixtures of modified coal and pulverized porous coal on the crushing strength relative to the roll power. In FIG. 2, the solid diamond, the solid square, and the solid triangle represent data of samples in which the moisture content of the mixture is 0%, 3.1%, and 6.1%, respectively, and the open triangle, the open square, and the open diamond represent data of samples in which the moisture content of the mixture is 9.2%, 15.4%, and 30.7%, respectively.

As shown in FIG. 2, the crushing strength of briquettes relative to the roll power per unit number of revolutions of the roll increases as the mixing ratio increases when the mixing ratio of pulverized porous coal to modified coal is up to 30% (the moisture content in the mixture is up to 9.2%). However, when the mixing ratio is 50% and 100% (the moisture content in the mixture is 15.4% and 30.7%), as the roll power exceeds the predetermined value, the crushing strength of briquettes tends to decrease. That is, when the mixing ratio is 50% and 100% (the moisture content in the mixture is 15.4% and 30.7%), the crushing strength of briquettes does not increase sufficiently compared with the other samples.

Furthermore, regarding the effect of decreasing the roll power due to mixing of pulverized porous coal, for example, in order to obtain briquettes with a crushing strength of 10 kg, a roll power of about 0.18 kW/rpm (extrapolated value) is required in the case of modified coal alone (mixing ratio of pulverized porous coal: 0%). When the mixing ratio of pulverized porous coal to modified coal is 30% (moisture content in mixture: 9.2%), the roll power is about 0.14 kW/rpm, resulting in a power saving of about 20%. Note that as the roll power increases, the pressure in briquetting under pressure increases.

As described above, in the case of modified coal alone (mixing ratio of pulverized porous coal: 0%), the roll power for obtaining briquettes with a crushing strength of 10 kg was found by extrapolation. The reason for this is that, in the case of modified coal alone (mixing ratio of pulverized porous coal: 0%), even if the roll power was increased to about 0.16 kW/rpm or more, it was not possible to obtain briquettes with good briquettability.

Figure 3:
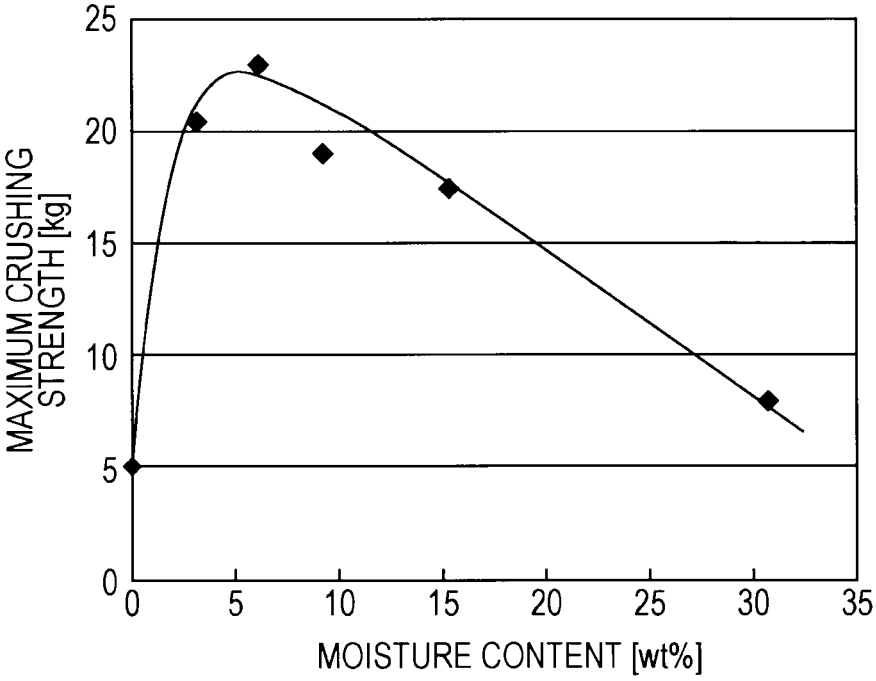
FIG. 3 is a graph showing the relationship between the moisture content of mixtures of modified coal and pulverized porous coal and the maximum crushing strength of briquettes which are briquetted products.

Next, the maximum crushing strength of briquettes realized in mixtures with various moisture contents by changing the roll power per unit number of revolutions of a double roll briquetting machine is shown in FIG. 3. FIG. 3 is a graph showing the relationship between the moisture content of mixtures of modified coal and pulverized porous coal and the maximum crushing strength of briquettes which are briquetted products.

As shown in FIG. 3, when the moisture content of the mixture of modified coal and pulverized porous coal is 3 wt % to 10 wt %, the maximum crushing strength of briquettes exceeds 20 kg.

As described above, by adding moisture to modified coal which has been subjected to the drying step to obtain a moist modified coal with a moisture content of 3 wt % to 10 wt %, and briquetting the moist modified coal under pressure, bonds between particles can be strengthened. As a result, it is possible to manufacture a briquetted solid fuel having high strength without using a binder, such as starch. That is, it is possible to reduce the briquetting cost while maintaining the strength of briquettes.

In addition, by using pulverized starting material porous coal in powder form in order to add moisture to modified coal, the amount of porous coal to be treated in the mixing step to the drying step decreases. When the amount of porous coal to be treated in the mixing step to the drying step decreases, the amount of a mixed oil including a heavy oil and a solvent oil to be consumed decreases, and it is possible to decrease the capacity of equipment in the individual steps. Thus, the manufacturing cost of the briquetted solid fuel can be reduced.

Furthermore, by using waste water from the evaporating unit 4 in order to add moisture to modified coal, it is possible to decrease the amount of waste water discharged from the system. As a result, the treatment cost of waste water discharged from the system can be suppressed, leading to a reduction in the manufacturing cost of the briquetted solid fuel in the entire plant.

The embodiments of the present invention have been described above. However, it is to be understood that the present invention is not limited to the embodiments described above, and various alterations are possible within the scope of the invention described in claims.

The invention claimed is:

1. A method for manufacturing a briquetted solid fuel comprising:

mixing a mixed oil comprising a heavy oil and a solvent oil with a pulverized porous coal having a moisture content of 30%-70% to obtain a slurry;

dewatering the slurry by heating to obtain a dewatered slurry;

separating the solvent oil from the dewatered slurry to obtain a cake;

heating the cake to further separate the solvent oil from the cake to obtain a modified coal in powder form;

adding pulverized porous coal having a moisture content of 30%-70% to the modified coal to obtain a moist modified coal with a moisture content of 3 wt % to 10 wt %; and briquetting the moist modified coal under pressure to produce said briquetted solid fuel.

2. The method as claimed in claim 1, wherein no binder is used in said method, and said briquetted solid fuel comprises no binder.

3. The method as claimed in claim 1, wherein the pulverized porous coal has a particle size of 0.05 to 3 mm.

4. The method as claimed in claim 1, wherein dewatering the slurry comprises heating the slurry to 70° C. to 100° C. in a preheating unit after which it is fed to an evaporation tank in which moisture is evaporated to dewater the slurry.

5. The method as claimed in claim 1, wherein solvent oil separated from the dewatered slurry, from the cake, or both, is recycled to the mixing oil.

6. The method as claimed in claim 1, wherein no binder is used in said method, and said briquetted solid fuel comprises no binder;

the pulverized porous coal has a particle size of 0.05 to 3 mm; and dewatering the slurry comprises heating the slurry to 70° C. to 100° C. in a preheating unit after which it is fed to an evaporation tank in which moisture is evaporated to dewater the slurry.

7. The method as claimed in claim 6, wherein solvent oil separated from the dewatered slurry, from the cake, or both, is recycled to the mixing oil.

* * * * *